United States Patent [19]

Mayer et al.

[11] Patent Number: 4,834,864

[45] Date of Patent: May 30, 1989

[54] ONCE-THROUGH COKING WITH SOLIDS RECYCLE

[75] Inventors: Francis X. Mayer; William E. Lewis, both of Baton Rouge, La.; Joseph P. Matula, Randolph Township, Dover County, N.J.; David W. Staubs, Baton Rouge, La.

[73] Assignee: Exxon Research and Engineering Company, Florham Park, N.J.

[21] Appl. No.: 97,117

[22] Filed: Sep. 16, 1987

[51] Int. Cl.[4] ..... C10G 69/06; C10G 13/06

[52] U.S. Cl. ..... 208/50; 208/54; 208/55

[58] Field of Search ..... 208/50, 54, 55, 57, 208/61, 81, 85, 127, 1; 210/496, 494.2, 499

[56] References Cited

U.S. PATENT DOCUMENTS

| | | | |
|---|---|---|---|
| 2,789,082 | 4/1957 | Barr et al. | 208/55 |
| 2,853,434 | 9/1954 | Moser, Jr. | 208/54 |
| 2,905,617 | 9/1959 | Jahnig et al. | 208/55 |
| 2,999,062 | 9/1961 | Henderson | 208/127 |
| 3,033,783 | 5/1962 | Lubben | 210/496 |
| 3,238,117 | 3/1966 | Arey, Jr. et al. | 208/85 X |
| 3,852,185 | 12/1974 | Christman et al. | 208/61 X |
| 4,072,616 | 2/1978 | Rohlig | 210/496 |

*Primary Examiner*—Glenn Caldarola
*Attorney, Agent, or Firm*—Henry E. Naylor

[57] ABSTRACT

Disclosed is a process wherein a scrubber bottom stream from a fluid coker is departiculated by passing it through a microfiltration system. The substantially solids-free filtrate is then upgraded by hydrotreating.

10 Claims, 1 Drawing Sheet

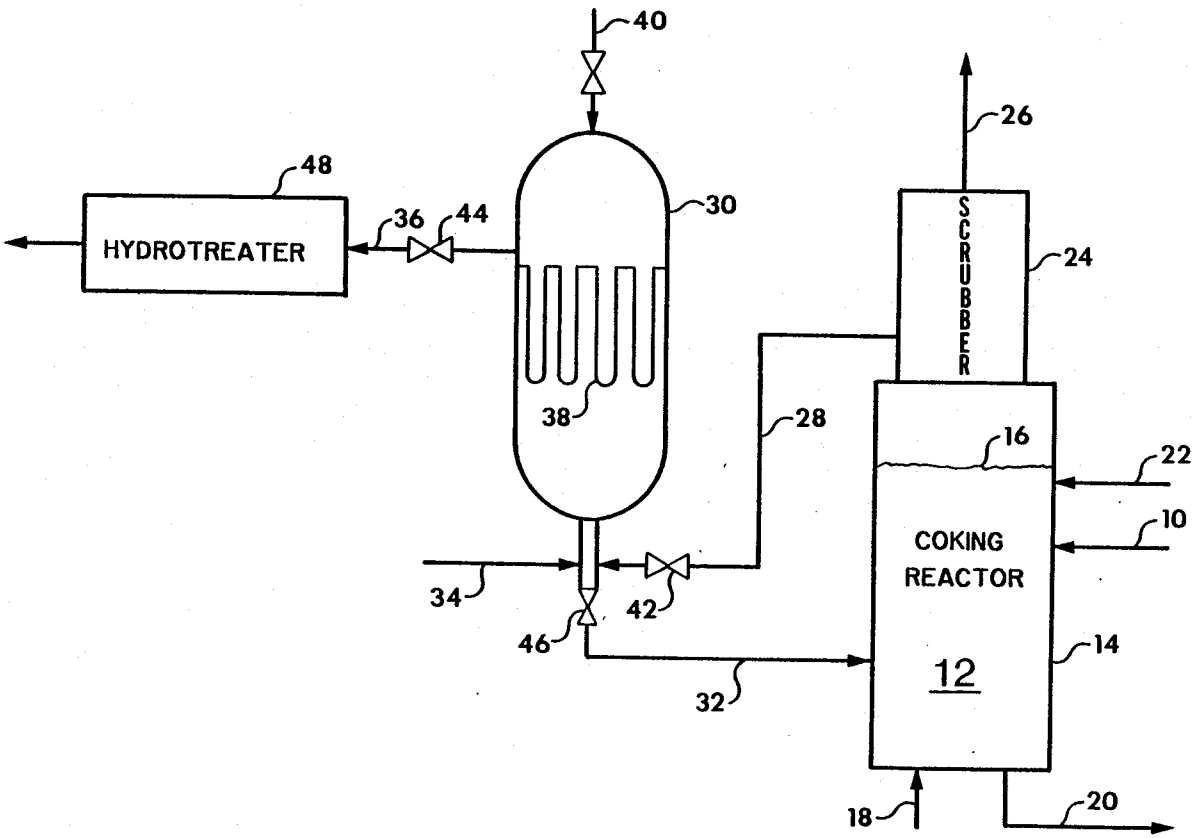
SCRUBBER
COKING REACTOR
12
HYDROTREATER
10
12
14
16
18
20
22
24
26
28
30
32
34
36
38
40
42
44
46
48

ONCE-THROUGH COKING WITH SOLIDS RECYCLE

FIELD OF THE INVENTION

The present invention relates to a fluid coking process for heavy petroleum feedstock, wherein scrubber bottoms are filtered to obtain a solids-laden fraction and a substantially solids-free filtrate. The solids-laden fraction is recycled to the coking zone and the substantially solids-free filtrate can be hydrotreated.

BACKGROUND OF THE INVENTION

Much work has been done over the years to convert heavy petroleum feedstocks to lighter and more valuable liquid products. One process developed through the years for accomplishing this conversion is fluid coking. In conventional fluid coking, a heavy petroleum feedstock is injected into a fluidized bed of hot, fine coke particles and is thus distributed uniformly over the surface of the coke particles where it is cracked to vapors and coke. The vapors pass through a cyclone which removes most of the entrained coke particles. The vapor is then discharged into a scrubber where the remaining coke particles are removed and the products cooled to condense heavy liquids. The resulting slurry, which usually contains from about 1 to about 3 weight percent coke particles, is recycled to the coking reactor. The overhead products from the scrubber are sent to fractionation for separation into gas, naphtha, and light and heavy gas oils.

The coke particles in the reactor vessel flow downwardly to a stripping zone at the base of the reactor where stripping steam removes interstitial product vapors from, or between, the coke particles, as well as some adsorbed liquids from the coke particles. The coke particles then flow down a stand-pipe and into a riser which leads to a burner where sufficient air is injected for burning part of the coke and heating the remainder sufficiently to satisfy the heat requirements of the coking reactor where the unburned hot coke is recycled thereto. Net coke above that consumed in the burner is withdrawn as product coke.

Another type of fluid coking process employs three vessels: a reactor, a heater, and a gasifier. Coke produced in the reactor is withdrawn, and is passed through the heater where a portion of the volatile matter is removed. The coke is then passed to a gasifier where it reacts, at elevated temperatures, with air and steam to form a mixture of carbon monoxide, carbon dioxide, hydrogen, nitrogen, water vapor, and hydrogen sulfide. The gas produced in the gasifier is heat exchanged in the heater to provide part of the reactor heat requirement. The remainder of the heat is supplied by circulating coke between the gasifier and the heater.

Still another type of fluid coking process is a so-called once-through coking process wherein the bottoms fraction from the scrubber is passed directly to a hydrotreating unit instead of being more conventionally recycled to extinction. The disadvantage with such a once-through process is that the bottoms fraction is so laden with fine coke particles that plugging of the hydrotreating unit occurs.

Consequently, there exists a need in the art for a fluidized coking process which is not limited by the disadvantages of the prior art and which results in a scrubber bottoms fraction substantially free of solids.

SUMMARY OF THE INVENTION

In accordance with the present invention, there is provided a process wherein a heavy hydrocarbonaceous oil is cracked to a vaporous product, including normally liquid hydrocarbons, and to coke, in a fluidized bed of solid particles in a coking zone maintained under fluidized coking conditions wherein a hot vaporous product from said coking zone is passed to a scrubbing zone where it is quenched, thereby resulting in a condensed heavy hydrocarbonaceous bottoms fraction and lighter products which include gaseous and normally liquid material, the improvement which comprises: (a) passing at least a portion of the bottoms fraction from said scrubbing zone to a microfiltration system characterized as containing a filtering means capable of retaining at least about 95 percent of the resulting solids, and capable of maintaining a flux of at least 0.05 to 0.5 gallons per minute per square feet (gpm/ft$^2$); (b) collecting the resulting substantially solids-free filtrate as a product stream; and (c) recycling the filtered solids to the coking zone.

In preferred embodiments of the present invention, the substantially solids-free filtrate is hydrotreated at temperatures from about 600° F. to about 820° F. at a hydrogen treat rate from about 500 to about 10,000 SCF/B (standard cubic feed per barrel) to remove such constituents as sulfur, nitrogen and metals as well as to increase the hydrogen to carbon ratio.

In yet further preferred embodiments of the present invention, other solids-laden material, such as catalytic cracker bottoms, slurry catalytic hydroconversion bottoms, and oil sludges are passed through the microfiltration system along with the scrubber bottoms fraction so that the solids present in these systems can also removed and recycled to the coking zone.

BRIEF DESCRIPTION OF THE DRAWINGS

FIG. 1 is a schematic flow diagram of one embodiment of the present invention.

DESCRIPTION OF THE INVENTION

Referring to the Figure, a hydrocarbonaceous oil, such as a vacuum distillation residuum having an atmospheric boiling point of about 1050° F.+ is passed by line 10 to a fluidized coking reactor 14. Although, for simplicity of description, vacuum residuum will be used to designate the hydrocarbonaceous oil used herein, it is understood that other hydrocarbonaceous oils suitable for fluid coking may also be used. Non-limiting examples of such oils include heavy and reduced petroleum crude oil, petroleum atmospheric residuum, pitch, tar sand oil, bitumen, shale oil, coal liquids, asphalts, and mixtures thereof. Typically, such feeds have a Conradson carbon content of at least about 5 weight percent, generally from about 5 to about 50 weight percent, and preferably above about 7 weight percent. (As to Conradson carbon content, see ASTM Test D189-65.)

A fluidized bed of solids 12, identifying the coking zone (e.g., coke particles having an average particle size from about 40 to about 1,000 microns, preferably about 150 microns), is maintained in reactor 14 having an upper level 16. A fluidizing gas is introduced into the base of the reactor through line 18 in an amount sufficient to obtain a superficial fluidizing velocity in the range of about 0.5 to 5 feet per second. The fluidizing gas may comprise vaporized normally gaseous hydrocarbons, hydrogen, hydrogen sulfide, steam, and mixtures thereof. Preferably, the fluidizing gas is steam. A stream of coke particles at a temperature from about 100° to about 1000° F., preferably from about 150° to about 300° F., in excess of the actual temperature of the coking zone, is admitted into the reactor by line 22, from the heater or burner, in an amount sufficient to maintain the temperature of the coking zone in the range of about 850° to about 1400° F., preferably from about 900° to about 1200° F. The pressure in the coking zone is maintained in the range from about 0 to about 150 pounds per square inch gauge (psig), preferably in the range of about 5 to about 45 psig. The lower portion of the reactor serves as a stripping zone to remove occluded hydrocarbonaceous material from the coke particles. A stream of stripped, relatively cold coke is withdrawn from the stripping zone by line 20 for passage into a coke burner, coke heater, or coke gasifier, where the coke is heated and recycled to the coking zone through line 22 to supply heat for the endothermic coking reaction. The heater may be operated as a conventional coke burner as disclosed in U.S. Pat. No. 2,881,130, which is incorporated herein by reference. Alternatively, the heater may be operated as a heat-exchange zone, such as disclosed in U.S. Pat. Nos. 3,661,543; 3,702,516; and 3,759,676, all of which are incorporated herein by reference.

In the coking zone, the hydrocarbonaceous oil, which is introduced via line 10, is catalytically, thermally, or both, converted by contact with the hot fluidized bed of coke particles, resulting in deposits forming on the surface of the particles and a vaporous product. The vaporous product, which comprises light and heavy hydrocarbonaceous material, including material boiling above 1050° F., as well as entrained coke particles, is passed to scrubbing zone 24. In the scrubbing zone, the vaporous coke product is quenched and heavy hydrocarbonaceous material is condensed. The lighter products, which include gaseous and normally liquid hydrocarbonaceous material, is removed overhead from the scrubber via line 26 for subsequent conventional fractionation and gas recovery. The bottoms fraction of the scrubber comprises the condensed portion of the vaporous coker product, as well as a relatively high concentration, up to about 3 weight percent, of fine coke particles. At least a portion of the scrubber bottoms fraction is withdrawn via line 28 and passed to microfiltration system 30. This bottoms fraction has a Conradson carbon content from about 0.5 to 1.5, preferably from about 0.7 to 1.2, and more preferably from about 0.8 to 1.0, times the Conradson carbon content of the feed.

Microfiltration systems which are suitable for use in the practice of this invention include those which have an effective substantially uniform pore size to selectively remove the fine coke particles in the slurry while maintaining an effective flux (permeation rate). By effective flux we mean that the filtering means of the microfiltration system will be chosen such that the rate of liquid passing through it will be of at least about 0.05 to 0.5 gallons per minute per square feet (gpm/ft$^2$). By effective substantially uniform pore size we mean that substantially all of the pores of the filtering means are approximately the same size and that the pore size is such that it will retain at least about 95 percent, preferably at least about 99 percent of particles having an average size of about submicron to about 50 microns. Further, the microfiltration system suitable for use herein is comprised of a material which is substantially resistant to chemical and physical attack by the scrubber bottoms fraction.

Non-limiting examples of such materials include ceramics and metals selected from the group consisting of stainless steeels and nickel-base alloys such as Monels and Inconels, both available from International Nickel Company Inc., and Hastelloys, available from Cabot Corporation.

Preferred microfiltration systems suitable for use herein include the sintered porous metal membrane systems comprised of stainless steel. Such systems are available from Mott Metallurgical Corporation and Pall Corporation. Such sintered porous metal membranes are generally constructed in a two step procedure from discrete, uniformly sized metal particles. The particles are first pressure formed in the basic shape desired, then heated under pressure. The resultant membrane has a porous structure originating from the spaces between the metal particles. The effective pore size can be determined by the starting particle size and the degree of heating as monitored by density increase. While such systems are available in configurations of flat sheets, tubes, and "socks" (tubes attached to so-called tube sheets), the preferred configuration for use herein is a sock configuration, as illustrated in the Figure hereof. It is within the scope of this invention that the filtering means can also be comprised of wire mesh or a composite of wire mesh and sintered porous membranes.

The microfiltration system of the instant invention can be operated in either the through-flow mode, the cross-flow mode, or a combination thereof. Preferred is the through-flow mode. In the through-flow mode, feed flow is usually perpendicular to the membrane surface, with all material, except that retained on the membrane surface, exiting as permeate. Through-flow has the advantage of producing high concentrates and thus maximizing liquid recovery. A potential limitation of through-flow processing is the variation of pressure and/or permeation rate which, due to coke build-up on the membrane surface, starts relatively high, then decreases. This necessitates batchwise, or at least semi-continuous, operation.

In the cross-flow mode, feed flow is parallel to the membrane surface and at a flow rate higher than that at which permeate is withdrawn. The resulting feed side turbulence tends to limit solids build-up at the membrane surface. After an initial, sometimes negligible, decline, permeation rates in the cross-flow mode should ideally remain constant and relatively high, with limited material on the membrane surface.

An obvious advantage of cross-flow processing is a continuous permeation rate. A disadvantage of cross-flow, relative to through-flow, is the limited recovery achievable and the resultant limitation on concentrates. The through-flow mode can be operated under constant feed pressure on constant feed flow conditions. The method will result in gradual build-up of solids on the membrane surface. These solids will have to be removed periodically to continue the process. For purposes of the present invention, constant feed flow conditions are preferred. This results in a variable pressure operation but constant permeate, or filtrate, output. The process is continued to a preset maximum pressure, at which point the feed flow must be stopped and retained material (filter cake) removed from the membrane prior to the next cycle.

Returning now to the Figure, feed enters near the bottom of the system via line 28 and fills the lower space around the membrane socks 38. Liquid filters through the socks while solids are retained on their outside surfaces. The clean filtrate, after filling the inside of the socks and the head of the housing, exits permeate outlet 36. In an inverted or "inside/out" design, the tube sheet to which the membrane socks are attached, is located at the bottom of the housing and the socks inverted with their open ends pointed down. Feed enters the unit at the feed inlet, fills the bottom of the housing and the inside of the socks where the solids collect. Solids-free permeate, or filtrate, exits the outlet located above the tube sheet near the bottom of the housing.

At the end of each processing cycle, typically when the pressure in the mirofiltration unit reaches an undesirable level, for example about 40 psi owing to the caking of solids on the sock membranes, feed inlet valve 42 is closed and, with the permeate outlet 44 also closed, the membrane sock is backflushed via line 40 with a pulse of fluid for a short duration to dislodge caked solids. The fluid may be vapor, liquid, or a mixture of vapor and liquid. Usually, this backflush will be at a pressure from about 20 to about 200 psi, preferably from about 40 to about 100 psi. The bottom drain valve 46 is then opened and the backflush gas expands, pushing the permeate, at the top, back through the membranes, dislodging the caked solids (filtercake), regenerating the membranes, and forcing the resulting solids-laden slurry, or concentrate, out the drain and through line 32 to the coking zone. The regeneration cycle typically requires about 30 to 45 seconds. It is understood that at least a portion of this solids-laden concentrate can be blended with the hydrocarbonaceous oil for introduction into the reactor.

It is also within the scope of this invention to introduce into the microfiltration system, via line 34, other solids-containing hydrocarbonaceous materials, such as catalytic cracker bottoms, hydroconversion bottoms, and oil sludges.

The filtrate may be passed, via line 36, to further processing, such as hydrotreating, deasphalting, etc. It is preferred that the filtrate, or permeate, be passed to a hydrotreating unit 48 for upgrading. The term "hydrotreating", as used herein, refers to any of the various processes for upgrading a hydrocarbonaceous oil by contact with hydrogen at elevated temperatures and pressures. Such processes include hydrorefining under reaction conditions of both relatively low severity, hydrofining under reaction conditions of relatively high severity accompanied with an appreciable cracking reaction, such as hydroisomerization, hydrodealkylation, as well as other reactions of hydrocarbonaceous oils in the presence of hydrogen. Examples of such include hydrodesulfurization, hydrodenitrogenation, and hydrocracking. Catalysts suitable for use herein for hydrotreating include any of the known hydrotreating catalysts. Non-limiting examples of such catalysts include those containing one or more Group VIB and one or more Group VIII metals on an alumina, silica, or alumina-silica support. Groups VIB and VII refer to groups of the Periodic Table of the Elements by E. H. Sargent and Company, copyright 1962, Dyna Slide Company. Such hydrotreating catalysts are disclosed in U.S. Pat. No. 4,051,021, which is incorporated herein by reference.

Typical hydrotreating conditions which may be used in the practice of the present invention are as follows:

| | Typical Range | Preferred Range |
|---|---|---|
| Temperature, °F. | | |
| Start-of-run | 600–750 | 650–700 |
| End-of-run | 725–825 | 730–800 |
| Pressure, psi | 400–10,000 | 500–3,000 |
| Hydrogen Rate, SCF/B[1] | 500–10,000 | 1,000–4,000 |
| Space Velocity, LHSV[2] | 0.05–5.0 | 0.08–1.0 |

[1]SCF/B = standard cubic feet per barrel.
[2]LHSV = liquid hourly space velocity.

The following examples are presented to illustrate the invention.

EXAMPLES 1 and 2

A vacuum residuum having a Conradson carbon content of 22.1 weight percent and an API Gravity at 60° F. of 6.9 was subjected to fluid coking at a temperature of about 950° F. The coker unit was operated in both a once-through mode and a more conventional recycle mode. That is, a recycle mode wherein the scrubber bottoms fraction is recycled to extinction. The unit was lined-out at 42 kB/SD (1,000 barrels/stream day), with scrubber bottoms recycled to the reactor in preparation for testing. During a first recycle test (24 hour duration), samples of product were collected and analyzed. The unit then underwent transition from recycle mode to once-through (O/T) mode by slowly, over a period of about 6 hours, reducing the percentage of scrubber bottoms recycled to the reactor until all of the scrubber bottoms were withdrawn as product. In parallel, the feed rate was increased from 42 kB/SD to 52 kB/SD, keeping constant, the total feed rate to the reactor. Samples of once-through scrubber bottoms were collected over a period of about 9 hours and analyzed. The unit was returned to recycle mode and samples were again collected over a 24 hour period and analyzed. Analysis results for both the recycle and once-through modes are given in Table I below. The data for the recycle mode is an average of the two test periods.

TABLE I

| | Operating Mode | | |
|---|---|---|---|
| Yields, wt. % FF | Recycle (Rec) | Once-Through (O/T) | O/T-Rec |
| $H_2S$ | 0.73 | 0.54 | −0.19 |
| $C_1$–$C_4$ | 13.76 | 12.08 | −1.68 |
| Total Liquid | 52.70 | 61.12 | +8.42 |
| Gross Coke | 32.81 | 26.26 | −6.55 |
| | 100.00 | 100.00 | 0 |

The above table shows the advantages of the coking process of the present invention versus conventional fluid coking. For example, total liquid yield is increased by more than 15 percent, coke make is decreased by about 20 percent, and $C_1$–$C_4$ make is decreased by more than 12 percent.

EXAMPLE 3

A portion of a scrubber bottoms stream from a fluid coking process operated in once-through mode, as set forth in Example 1 above, was split into four separate streams. Each was passed, at a temperature of 400° F., through a microfiltration system, wherein the pore size of the filtering means for each stream was different, as indicated by 30 in the sole Figure and Table II hereof. The membrane sock of the microfiltration system was a 0.5 $ft^2$ sintered stainless steel single element having a substantially uniform pore size as set forth in Table II below. Each time the system reached a pressure of 80 psi, introduction of the stream into the microfiltration system was stopped and the membrane sock element was backflushed with steam to remove the filter-cake after which introduction of the stream into the system was resumed.

TABLE II

| Pore Size | 9 Micron | 10 Micron | 2 Micron | 5 Micron |
|---|---|---|---|---|
| Number cycles | 15 | 14 | 17 | 16 |
| Flux Rate, gpm/$ft^2$ | 0.16 | 0.16 | 0.16 | 0.1–0.12 |
| Solids Conc., Wt. % | 0.6–4.1 | 1.9–2.3 | 1.2–3.9 | 0.4–3.5 |
| Median Particle Size Range (Microns) | 4–10 | 6–34 | 10.3–23.6 | 9.1–22.9 |
| Filtrate Solids Conc., ppm | 0–50 | 0–50 | 0.50 | 0.35 |
| Cake Thickness, inches | 0.02–0.23 | 0.09–0.56 | 0.23–0.60 | 0.12–0.5 |
| Cycle Time, Minutes | 10–65 | 20–97 | 46–134 | 42–295 |

EXAMPLE 4

A scrubber bottoms stream resulting from fluid coking in once-through mode was passed through a microfiltration system as set forth above, but containing a membrane sock comprised of a 0.94 $ft^2$ single sintered stainless steel element having an average pore size of 0.5 microns. The stream was passed through the microfiltration system for a period of five days at a temperature of 400° F. to 600° F. Passage of the stream through the microfiltration system was stopped each time the pressure reached 20–40 psi, whereupon the membrane socks were backflushed with a nitrogen pulse to remove the filtrate cake after which passage of the stream was resumed for another cycle. The results are set forth in Table III below.

TABLE III

| | |
|---|---|
| Pore Size, microns | 0.5 |
| Number cycles | 130 |
| Flux Rate, gpm/ft2 | 0.2–0.53 |
| Solids Conc., wt. % | 1.6–6.0 |
| Med. Size Microns | 50–78 |
| Filtrate Solids Conc., ppm | 0–44 |
| Cake Thickness, inches | 0.2–1.0 |
| Cycle Time, minutes | 9–92 |

EXAMPLE 5

A scrubber bottoms stream from a once-through coking mode, as described above, and containing from about 1 to 2 weight percent solids, is mixed with a process gas oil and passed to a fixed bed hydrotreating unit for upgrading. It will be found that the fixed bed of the hydrotreating unit undergoes plugging after a period of time owing to the presence of particulates in the scrubber bottoms stream.

EXAMPLE 6

The above example is repeated except the scrubber bottoms stream is passed through a microfiltration system to remove substantially all of the particulate matter. The filtrate is blended with a process gas oil and introduced into a fixed bed hydrotreating unit. It will be found that the fixed bed does not plug over an extended period of time.

What is claimed is:

1. In a process wherein heavy hydrocarbonaceous oil is cracked to vaporous products, including normally liquid hydrocarbons, and to coke, in a fluidized bed of solid particles in a coking zone maintained under fluidized coking conditions wherein a hot vaporous product from said coking zone is passed to a scrubbing zone, the improvement which comprises:

(a) passing at least a portion of the resulting solids-containing bottoms fraction from said scrubbing zone to a microfiltration system characterized as containing a filtering means comprised of a sintered porous ceramic or metal membrane and having a substantially uniform pore size capable of retaining at least about 95 percent of the solids and capable of maintaining an effective flux thereby producing a solids-laden fraction and a substantially solids-free filtrate;

(b) recycling the filtered solids to the coking zone; and (c) hydrotreating, in the presence of a catalyst, at least a portion of the substantially solids-free filtrate at a temperature from about 600° F. to 800° F., a pressure from about 400 to 10,000 psi and a hydrogen treat rate from about 500 to 10,000 standard cubic feet per barrel.

2. The process of claim 1 wherein the hydrocarbonaceous oil is a vacuum distillation residuum.

3. The process of claim 1 wherein the metal is selected from iron- and nickel-based alloys.

4. The process of claim 3 wherein the iron-based alloys are stainless steels.

5. The process of claim 1 wherein the coking zone is maintained at a temperature of about 850° F. to about 1400° F. and a pressure from about 0 to about 150 psig.

6. The process of claim 5 wherein the coking zone is maintained at a temperature from about 900° F. to about 1200° F. and a pressure from about 5 to about 45 psig.

7. The process of claim 1 wherein another solids-laden stream is passed through the microfiltration system along with the scrubber bottoms fraction, which other solids-laden stream is selected from the group consisting of catalytic cracker bottoms, slurry catalytic hydroconversion bottoms, and oil sludges.

8. The process of claim 1 wherein the substantially solids-free filtrate is hydrotreated at a temperature from about 600° F. to 800° F., a pressure from about 400 to 10,000 psi and a hydrogen treat rate from about 500 to about 10,000 standard cubic feet per barrel of feed.

9. The process of claim 8 wherein the filtering means of the microfiltration system is comprised of a sintered porous metal membrane whose metal is selected from the group consisting of iron and nickel-based alloys chemically and physically resistant to scrubber bottoms fraction.

10. The process of claim 1 wherein the flux is at least about 0.1 gpm/$ft^2$.

* * * * *